US011148066B2

(12) United States Patent
Zhu

(10) Patent No.: US 11,148,066 B2
(45) Date of Patent: Oct. 19, 2021

(54) BRACKET AND CONNECTOR FOR MODULAR LUMINAIRE AND MODULAR LUMINAIRE WITH BRACKET AND CONNECTOR

(71) Applicant: HUNAN YUEGANG MOOKRAY INDUSTRIAL CO., LTD., Changde (CN)

(72) Inventor: Heng Zhu, ShenZhen (CN)

(73) Assignee: HUNAN YUEGANG MOOKRAY INDUSTRIAL CO., LTD., Changde (CN)

( * ) Notice: Subject to any disclaimer, the term of this patent is extended or adjusted under 35 U.S.C. 154(b) by 39 days.

(21) Appl. No.: 16/608,177

(22) PCT Filed: May 19, 2017

(86) PCT No.: PCT/CN2017/085221
§ 371 (c)(1),
(2) Date: Oct. 24, 2019

(87) PCT Pub. No.: WO2018/196065
PCT Pub. Date: Nov. 1, 2018

(65) Prior Publication Data

US 2021/0102689 A1 Apr. 8, 2021

(30) Foreign Application Priority Data

Apr. 27, 2017 (CN) ..... 201710289318.X

(51) Int. Cl.
*A63H 33/08* (2006.01)
*A63H 33/10* (2006.01)
(Continued)

(52) U.S. Cl.
CPC ..... *A63H 33/108* (2013.01); *F21S 2/005* (2013.01); *F21S 6/003* (2013.01); *F21V 15/01* (2013.01);
(Continued)

(58) Field of Classification Search
CPC ..... A63H 33/108; F21S 2/005; F21V 21/108; F21V 23/06
See application file for complete search history.

(56) References Cited

U.S. PATENT DOCUMENTS 6,024,626 A * 2/2000 Mendelsohn ..... A63H 33/046 446/124
7,322,873 B2 * 1/2008 Rosen ..... A63H 33/042 446/124
(Continued)

FOREIGN PATENT DOCUMENTS

CN 2351169 Y 12/1999
CN 2560816 Y 7/2003
(Continued)

OTHER PUBLICATIONS

English Machine Translation of CN 20376860 U that was disclosed on Applicant's IDS (Year: 2014).*

*Primary Examiner* — Keith G. Delahoussaye
(74) *Attorney, Agent, or Firm* — Bayramoglu Law Offices LLC

(57) ABSTRACT

A bracket for modular luminaire includes a polyhedral module and a connector connected to the polyhedral module. The polyhedral module is a polyhedron provided with a cavity therein, and each surface of the polyhedron is provided with a stepped through-hole connected to the cavity, thereby forming a first annular protrusion at a junction of the stepped through-hole and the cavity. The connector includes a connector body having a cylindrical shape. On an outer periphery of the connector body, a second annular protru-
(Continued)

sion, a third annular protrusion, a fourth annular protrusion, and a fifth annular protrusion protrude outwards in a radial direction and are spaced apart from each other, and formed successively from a left end portion to a right end portion of the connector body. A left end of the connector is inserted into the stepped through-hole of the polyhedral module.

13 Claims, 7 Drawing Sheets

(51) Int. Cl.

| | |
|---|---|
| ***F21S 2/00*** | (2016.01) |
| ***F21V 21/108*** | (2006.01) |
| ***F21V 23/04*** | (2006.01) |
| ***F21V 23/06*** | (2006.01) |
| ***F21V 15/01*** | (2006.01) |
| ***F21V 21/22*** | (2006.01) |
| ***F21S 6/00*** | (2006.01) |
| *A63H 33/04* | (2006.01) |

(52) U.S. Cl.
CPC ..... *F21V 21/108* (2013.01); *F21V 21/22* (2013.01); *F21V 23/04* (2013.01); *F21V 23/06* (2013.01); *A63H 33/042* (2013.01); *A63H 33/101* (2013.01); *A63H 33/102* (2013.01); *A63H 33/103* (2013.01); *A63H 33/105* (2013.01); *A63H 33/106* (2013.01)

(56) References Cited

U.S. PATENT DOCUMENTS

| | | | | |
|---|---|---|---|---|
| 7,731,558 | B2 * | 6/2010 | Capriola | A63H 33/042 446/91 |
| 8,310,175 | B2 * | 11/2012 | Van Endert | F21V 21/00 315/318 |
| 8,517,789 | B2 * | 8/2013 | Barber | A63H 33/042 446/91 |
| 8,690,631 | B2 * | 4/2014 | Nag | A63H 33/086 446/91 |
| 8,753,164 | B2 * | 6/2014 | Hansen | A63H 33/042 446/91 |
| 8,801,491 | B2 * | 8/2014 | Bruder | A63H 33/101 446/124 |
| 9,222,655 | B2 * | 12/2015 | Radermacher | F21S 2/005 |
| 10,376,804 | B2 * | 8/2019 | Lu | F21L 4/02 |
| 10,758,836 | B2 * | 9/2020 | Akishbekov | A63H 33/086 |
| 2003/0148700 | A1 * | 8/2003 | Arlinsky | G09B 1/40 446/91 |
| 2009/0047863 | A1 * | 2/2009 | Capriola | A63H 33/042 446/91 |
| 2010/0244692 | A1 | 9/2010 | Van Endert | |
| 2010/0311300 | A1 * | 12/2010 | Hansen | A63H 33/042 446/91 |
| 2011/0021107 | A1 * | 1/2011 | Nag | A63H 33/042 446/91 |
| 2011/0217898 | A1 * | 9/2011 | Barber | A63H 33/042 446/91 |
| 2013/0163235 | A1 * | 6/2013 | Chuang | F21V 15/01 362/190 |
| 2015/0251104 | A1 * | 9/2015 | Lange | A63H 33/046 446/92 |
| 2016/0339351 | A1 * | 11/2016 | Akishbekov | A63H 33/108 |
| 2018/0056205 | A1 * | 3/2018 | Lu | A63H 33/042 |
| 2019/0319462 | A1 * | 10/2019 | Hsu | H04R 1/028 |

FOREIGN PATENT DOCUMENTS

| | | | |
|---|---|---|---|
| CN | 201377700 | Y | 1/2010 |
| CN | 202410174 | U | 9/2012 |
| CN | 203384710 | U | 1/2014 |
| CN | 203736860 | U | 7/2014 |
| CN | 204254321 | U | 4/2015 |
| CN | 105569194 | A | 5/2016 |
| CN | 205261288 | U | 5/2016 |
| CN | 205709276 | U | 11/2016 |
| CN | 106979506 | A | 7/2017 |
| CN | 206682897 | U | 11/2017 |
| DE | 20319292 | U1 | 3/2004 |
| JP | 2007050680 | A | 3/2007 |
| WO | 9902234 | A1 | 1/1999 |

* cited by examiner

BRACKET AND CONNECTOR FOR MODULAR LUMINAIRE AND MODULAR LUMINAIRE WITH BRACKET AND CONNECTOR

CROSS REFERENCE TO THE RELATED APPLICATIONS

This application is the national phase entry of International Application No. PCT/CN 2017/085221, filed on May 19, 2017, which is based upon and claims priority to Chinese Patent Application No. 201710289318.X, filed on Apr. 27, 2017, the entire contents of which are incorporated herein by reference.

TECHNICAL FIELD

The present disclosure relates to the field of illumination technology, and particularly to a bracket and a connector for modular luminaires and a modular luminaire with the bracket and the connector.

BACKGROUND

With the advancement of science and technology, the LED solid-state light sources have become increasingly prevalent, and more and more people are using the LED solid-state light source as illuminating devices. The LED light source has incomparable advantages over conventional light sources, such as low calorific value, good controllability, and rich light color performance. Thus, it is an inevitable trend to replace the traditional light source with the LED light source. The process of replacing the traditional light source has also been greatly promoted. However, LED luminaires also have some deficiencies. For example, the luminaire bracket is usually made by molding and handcrafting, but the molding costs are high and the handcrafting is inefficient. Therefore, the bracket for the LED luminaires has poor adaptability, and usually only one bracket corresponds to one luminaire, which results in poor commonality.

SUMMARY

In view of the deficiencies of the prior art, the present disclosure provides a bracket and a connector for modular luminaires and a modular luminaire with the bracket and the connector.

The specific technical solution of a bracket for modular luminaires of the present disclosure is as follows:

A bracket for modular luminaires includes a polyhedral module and a connector connected to the polyhedral module. The polyhedral module is a polyhedron provided with a cavity therein, and each surface of the polyhedron is provided with a stepped through-hole connected to the cavity, thereby forming a first annular protrusion at a junction of the stepped through-hole and the cavity. The connector includes a connector body having a cylindrical shape; and the connector body is provided with a through-hole along an axial direction. On the outer periphery of the connector body, a second annular protrusion, a third annular protrusion, a fourth annular protrusion, and a fifth annular protrusion protrude outwards in a radial direction and are formed successively from a left end portion to a right end portion of the connector body. The second annular protrusion, the third annular protrusion, the fourth annular protrusion and the fifth annular protrusion are spaced apart. A left end of the connector is inserted into the stepped through-hole of the polyhedral module, and the first annular protrusion is engaged between the second annular protrusion and the third annular protrusion so that the connector is detachably connected to the polyhedral module. A plurality of the polyhedral modules are interconnected via the connectors as needed to form the bracket for modular luminaires.

By the arrangement of the stepped through-hole and the first annular protrusion on the polyhedral module, and the arrangement of the second annular protrusion, the third annular protrusion, the fourth annular protrusion and the fifth annular protrusion on the connector, the polyhedral module and the connector can be detachably connected together in a snap-fit manner; and a plurality of the polyhedral modules are interconnected via the connectors as needed to form the bracket for modular luminaires, thereby solving the problem of "one bracket only corresponds to one luminaire" in the prior art.

Further, a first through-hole connected to the cavity is provided on each surface of the polyhedral module; and two first through-holes located on opposite surfaces of the polyhedral module correspond to each other.

Because the stepped through-hole and first through-hole intercommunicate and are provided on the polyhedral module and the connector body is provided with the through-hole along the axial direction, a reinforcing strip can be inserted into a plurality of the interconnected polyhedral modules for reinforcing, fixing and supporting the bracket for modular luminaires; or a wire can be inserted into the plurality of interconnected polyhedral modules for forming an electrical connection in the bracket for modular luminaires.

According to a preferred embodiment, a portion between the third annular protrusion and the fourth annular protrusion of the connector body is wavy, zigzag or threaded, so that the portion between the third annular protrusion and the fourth annular protrusion of the connector body forms a retractable structure.

By the arrangement of the retractable structure in the middle position of the connector body, the connection portion between two polyhedral modules can be bent to change or adjust the connection angle.

According to a preferred embodiment, the bracket further includes a cover sheet. The cover sheet includes a sheet body and a snap-fit portion connected to the sheet body. The sheet body is a decorative sheet having a size matching the size of the surface of the polyhedral module on an outer surface of the bracket for modular luminaires. The snap-fit portion includes a first cylindrical platform provided on the sheet body and a second cylindrical platform coaxially provided on the first cylindrical. Moreover, a diameter of the second cylindrical platform is smaller than that of the first cylindrical platform, so that the snap-fit portion forms into a stepped platform matching the stepped through-hole. Through the matching of the snap-fit portion with the stepped through-hole, the cover sheet is connected to the polyhedral module to form an interference fit.

A decorative surface of the cover sheet can be provided with different colors, textures or patterns to play the role of decorating the luminaire. Moreover, the cover sheet and the polyhedral module are connected by the interference fit that can be detached from the connection and be replaced at any time, thereby satisfying the preferences of various people.

According to a preferred embodiment, the bracket further includes a cover sheet. The cover sheet includes a sheet body and a snap-fit portion connected to the sheet body. The sheet body is a decorative sheet matching the size of the surface of the polyhedral module on an outer surface of the bracket for modular luminaires. The snap-fit portion includes a cylinder provided on the sheet body. A sixth annular protrusion and a seventh annular protrusion protrude outwards in a radial direction and are formed on an outer periphery of the cylinder; and the sixth annular protrusion is spaced apart from the seventh annular protrusion. The snap-fit portion is inserted into the stepped through-hole of the polyhedral module, and the first annular protrusion is engaged between the sixth annular protrusion and the seventh annular protrusion, so the cover sheet is connected to the polyhedral module in a snap-fit manner.

According to a preferred embodiment, a second through-hole is provided on the cover sheet. The cover sheet provided with the second through-hole is installed at a position where a power supply port is mounted on the bracket for modular luminaires, so that the power supply port is exposed to facilitate the plugging in of the power supply.

According to a preferred embodiment, the bracket further includes a reinforcing strip. The reinforcing strip passes through the stepped through-holes or the first through-holes on the plurality of polyhedral modules for reinforcing, fixing and supporting the bracket for modular luminaires.

According to a preferred embodiment, the bracket further includes a wire. The wire passes through the stepped through-holes or the first through-holes on the plurality of polyhedral modules for forming an electrical connection in the bracket for modular luminaires.

The specific technical solution of a modular luminaire of the present disclosure is as follows:

A modular luminaire includes the bracket for modular luminaires as described above and a light source module mounted on the bracket for modular luminaires.

According to a preferred embodiment, a power supply port and a control switch are provided on the bracket for modular luminaires; the power supply port and the control switch are interconnected via a wire; and the control switch and the light source module are interconnected via a wire.

Compared with the prior art, the bracket for modular luminaires of the present disclosure has the following advantages:

In the bracket for modular luminaires of the present disclosure, by the arrangement of the stepped through-hole and the first annular protrusion on the polyhedral module, and the arrangement of the second annular protrusion, the third annular protrusion, the fourth annular protrusion and the fifth annular protrusion on the connector, the polyhedral module and the connector can be detachably connected together in an snap-fit manner. A plurality of the polyhedral modules are interconnected via the connectors as needed to form the bracket for modular luminaires, thereby solving the problem of "one bracket only corresponds to one luminaire" in the prior art.

REFERENCE DESIGNATOR LIST

Figure 1:
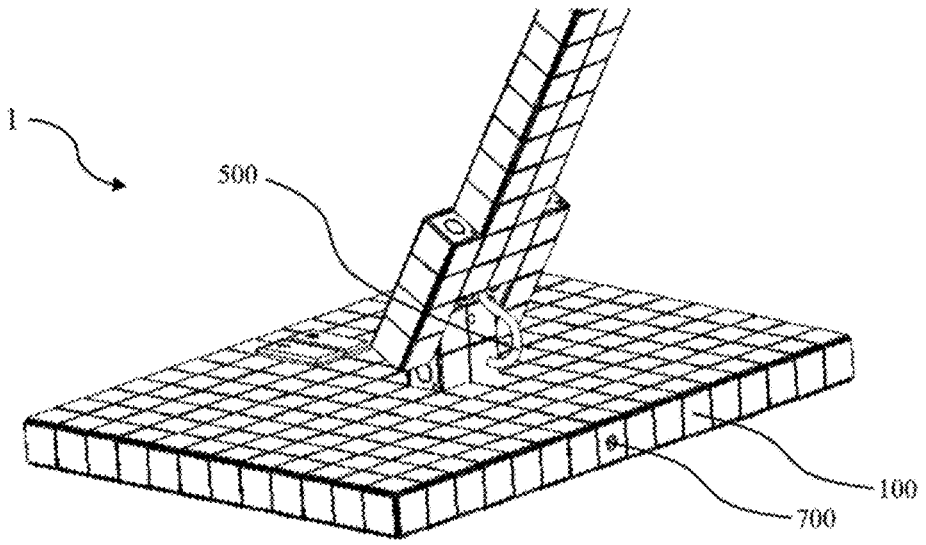
FIG. 1 is a structural schematic diagram of a preferred embodiment of a bracket for modular luminaires according to the present disclosure.

1—bracket for modular luminaires
2—modular luminaire
100—polyhedral module
110—cavity
120—stepped through-hole
130—first annular protrusion
140—first through-hole
200—connector
210—connector body
211—through-hole
212—second annular protrusion
213—third annular protrusion
214—fourth annular protrusion
215—fifth annular protrusion
300—cover sheet
310—sheet body
320—snap-fit portion
321—first cylindrical platform
322—second cylindrical platform
323—cylinder
324—sixth annular protrusion
325—seventh annular protrusion
330—second through-hole
400—reinforcing strip
500—wire
600—light source module
700—power supply port
800—control switch

DETAILED DESCRIPTION OF THE EMBODIMENTS

The present disclosure will be described in detail hereinafter with reference to the drawings.

Embodiment 1

A preferred embodiment of a bracket for a modular luminaire of the present disclosure is shown in FIGS. 1-9, 11 and 12.

The specific technical solution of the bracket for modular luminaires of the present embodiment is as follows:

The bracket 1 for modular luminaires includes the polyhedral module 100 and the connector 200 connected to the polyhedral module 100. The polyhedral module 100 is detachably connected to the connector 200 by a snap-fit connection structure. The plurality of polyhedral modules 100 are interconnected by the connectors 200 as needed to form the bracket for modular luminaires.

In the present disclosure, the polyhedral module 100 may be an irregular tetrahedron, an irregular hexahedron, an irregular octahedron, etc., or may be a regular tetrahedron, a cuboid, a regular hexahedron, or a regular octahedron, etc.

The present embodiment will be described in detail below with an example showing that the polyhedral module 100 is a regular hexahedron.

Figure 3:
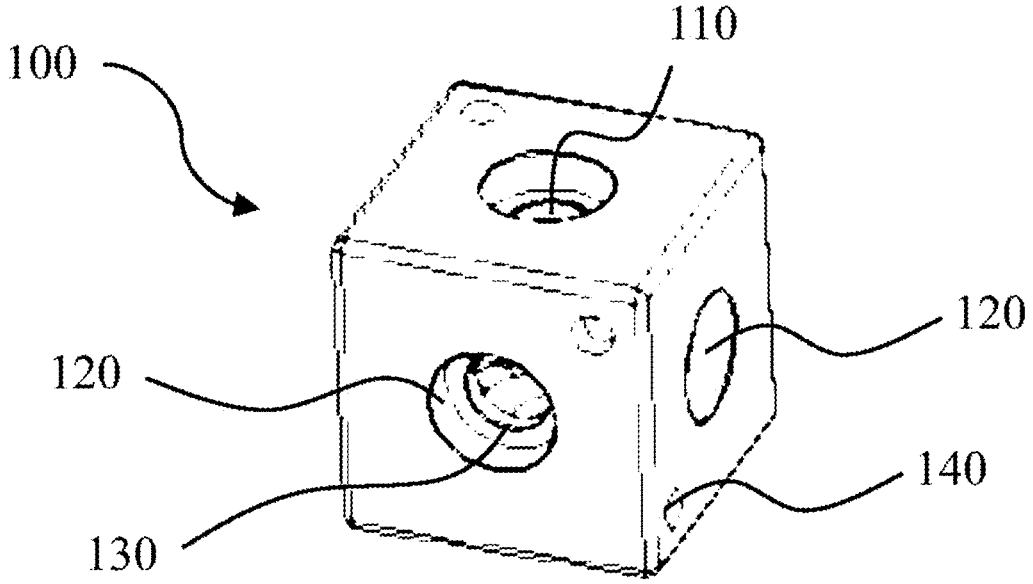
FIG. 3 is a schematic diagram showing a preferred embodiment of a polyhedral module in the bracket for modular luminaires according to the present disclosure.

As shown in FIG. 3, the polyhedral module 100 is a regular hexahedron provided with the cavity 110 therein, and each surface of the hexahedron is provided with the stepped through-hole 120 connected to the cavity 110, thereby forming the first annular protrusion 130 at a junction of the stepped through-hole 120 and the cavity 110. Preferably, the polyhedral module 100 is made of plastic.

Further, the first through-hole 140 connected to the cavity 110 is provided on each surface of the polyhedral module 100; and two of the first through-holes 140 located on opposite surfaces of the polyhedral module 100 correspond to each other.

Because the stepped through-hole 120 and first through-hole 140 intercommunicate and are provided on the polyhedral module 100, and the connector body 211 is provided with the through-hole 211 along the axial direction, the reinforcing strip 400 can be inserted into the plurality of the interconnected polyhedral module 100 for reinforcing, fixing and supporting the bracket for modular luminaires; or a wire can be inserted into the plurality of interconnected polyhedral modules 100 for forming an electrical connection in the bracket for modular luminaires.

The connector 200 may be made of a soft resin material or a hard resin material, which also has different lengths and types.

Figure 4:
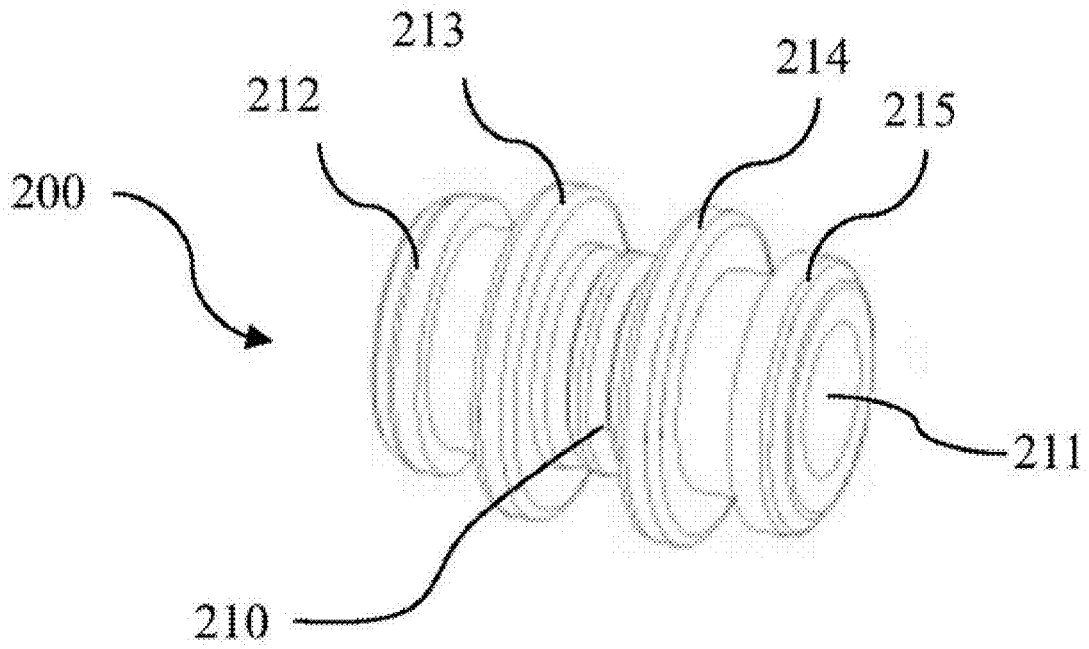
FIG. 4 is a schematic diagram showing a preferred embodiment of a connector in the bracket for modular luminaires according to the present disclosure.

As shown in FIG. 4, the connector 200 includes the connector body 210 having a cylindrical shape; and the connector body 210 is provided with the through-hole 211 along an axial direction. On an outer periphery of the connector body 210, the second annular protrusion 212, the third annular protrusion 213, the fourth annular protrusion 214, and the fifth annular protrusion 215 protrude outwards in a radial direction and are formed successively from a left end portion to a right end portion of the connector body 210.

The second annular protrusion 212, the third annular protrusion 213, the fourth annular protrusion 214 and the fifth annular protrusion 215 are spaced apart.

Figure 6:
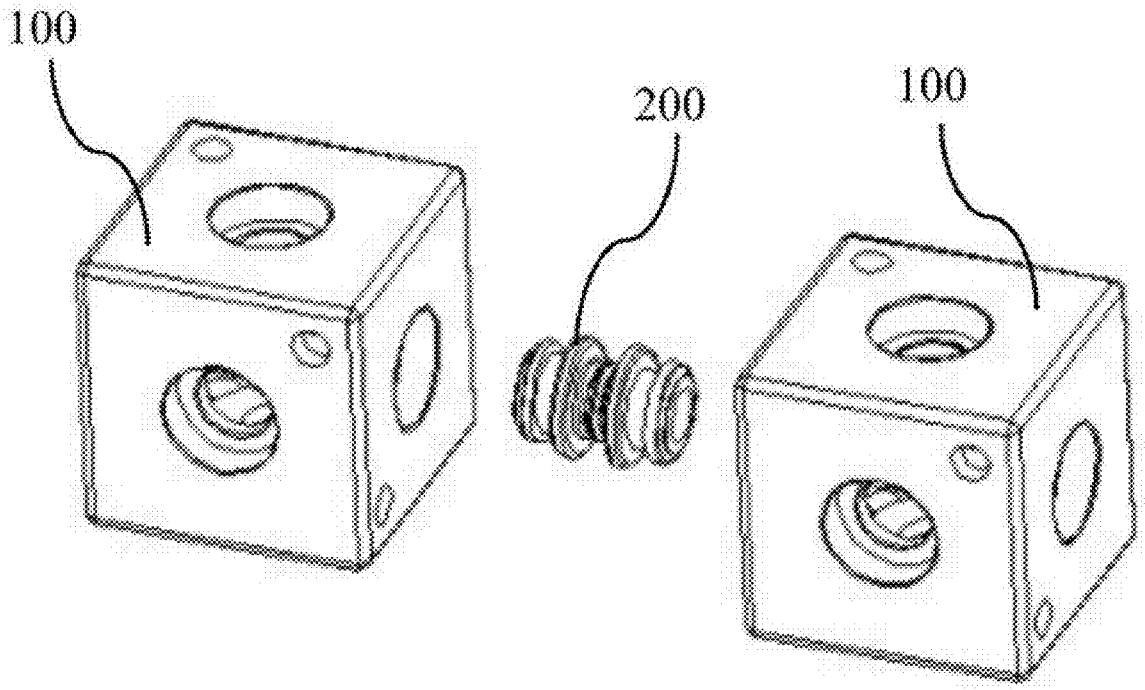
FIG. 6 is a schematic diagram showing a process of connecting the polyhedral module and the connector in the bracket for modular luminaires according to the present disclosure.
Figure 7:
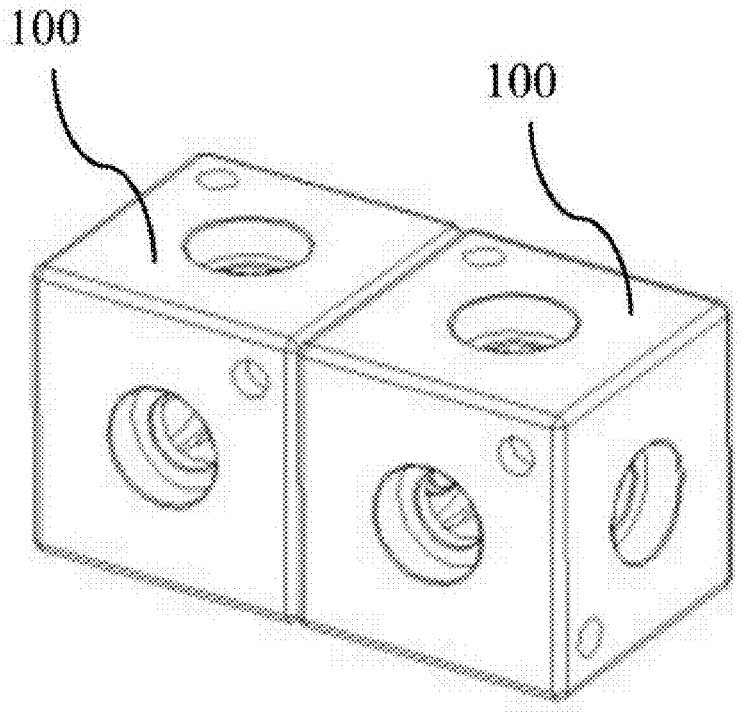
FIG. 7 is a schematic diagram showing a connection state of the polyhedral module and the connector in the bracket for modular luminaires according to the present disclosure.
Figure 8:
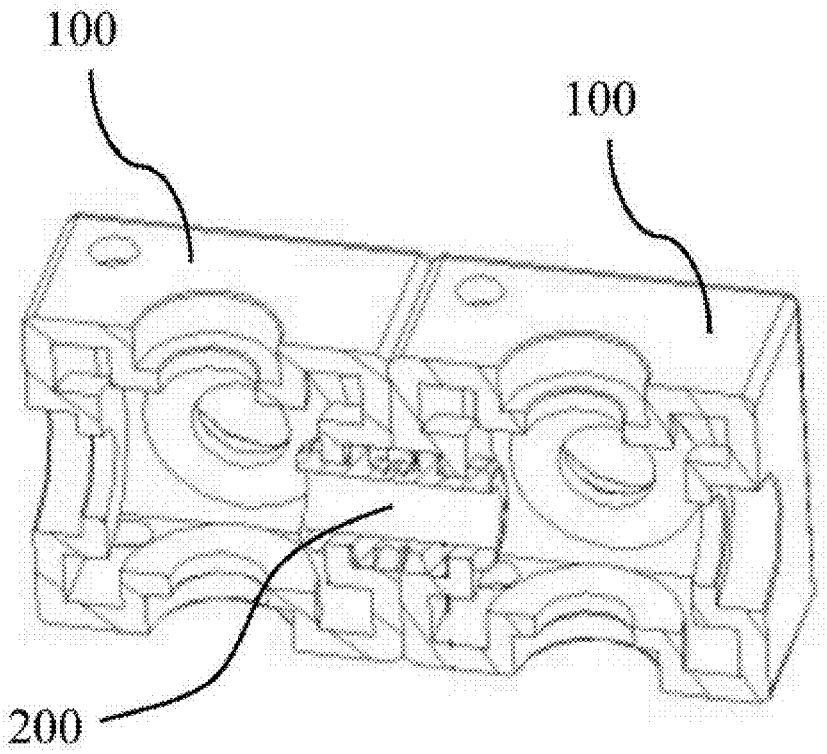
FIG. 8 is a cross-sectional view showing the connection state of the polyhedral module and the connector of FIG. 7.

As shown in FIGS. 6, 7 and 8, a left end of the connector 200 is inserted into the stepped through-hole 120 of the polyhedral module 100, and the first annular protrusion 130 is engaged between the second annular protrusion 212 and the third annular protrusion 213, so that the connector 200 is detachably connected to the polyhedral module 100.

Any two polyhedral modules 100 are connected by the connector 200, and a plurality of the polyhedron modules 100 are connected in series to form a strip structure. The plurality of strip structures can also be interconnected through the corresponding stepped through-holes 120 on the polyhedral module 100 and the connector 200, so that the plurality of polyhedral modules 100 are interconnected via the connector 200 as needed, thereby forming the bracket for modular luminaires as shown in the FIGS. 1 and 2.

In the prior art, the luminaire bracket is usually made in the manner of molding and handcrafting, but the molding is expensive and the handcrafting is inefficient. Therefore, the bracket for LED luminaires has poor adaptability, and usually only one bracket corresponds to one luminaire, which causes a poor commonality. In order to solve this technical problem, the present disclosure provides a structural design of a bracket for modular luminaires based on long-term research. The polyhedral modules can be arbitrarily connected in a plug-in manner, bent, discolored, and fixed. Then wires can be connected inside the polyhedron module to form a low-cost, structurally common, simple, variable-shaped frame/bracket structure for luminaires.

Specifically, by the arrangement of the stepped through-hole 120 and the first annular protrusion 130 on the polyhedral module, and the arrangement of the second annular protrusion 212, the third annular protrusion 213, the fourth annular protrusion 214 and the fifth annular protrusion 215 on the connector 200. The polyhedral module and the connector 200 is connected together in an snap-fit manner that can easily be detached; and a plurality of the polyhedral modules 100 are interconnected via the connector 200 as needed to form the bracket for modular luminaires, thereby solving the problem of "one bracket only corresponds to one luminaire" in the prior art.

Figure 5:
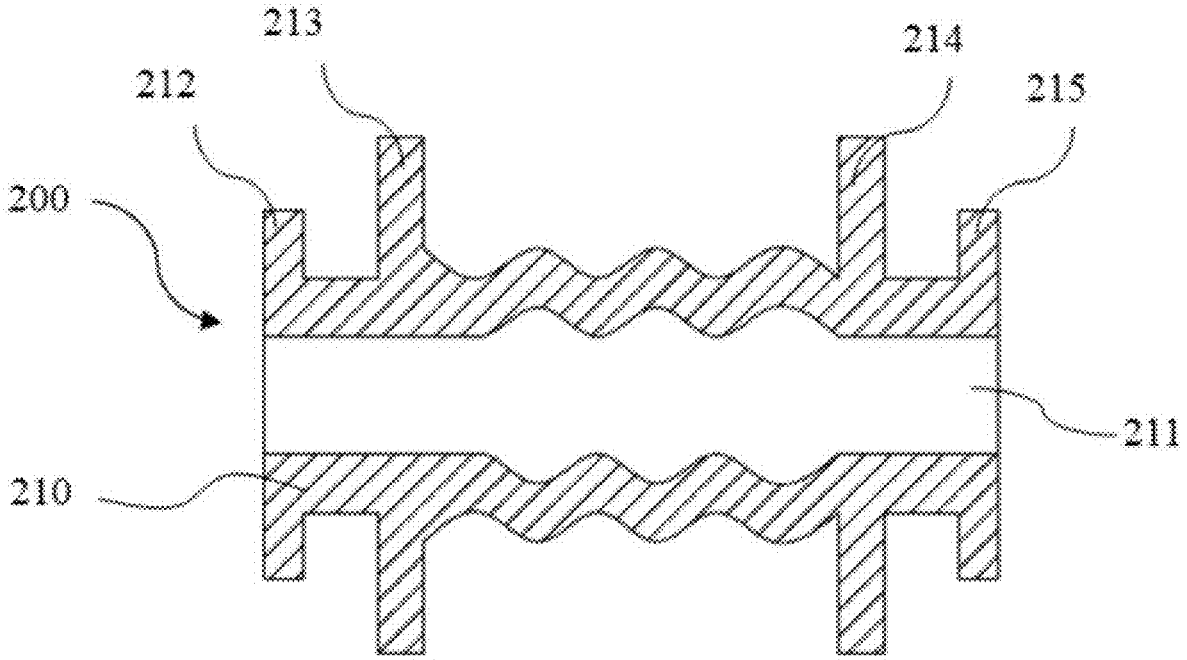
FIG. 5 is a cross-sectional view of the connector shown in FIG. 4.

Preferably, a portion between the third annular protrusion 213 and the fourth annular protrusion 214 of the connector body 210 is wavy, zigzag, or threaded, so that the portion between the third annular protrusion 213 and the fourth annular protrusion 214 of the connector body 210 forms a retractable structure, as shown in FIG. 5.

By the arrangement of a retractable structure in the middle position of the connector body 210, a connection portion between two polyhedral modules 100 can be bent to change or adjust the connection angle.

Figure 9:
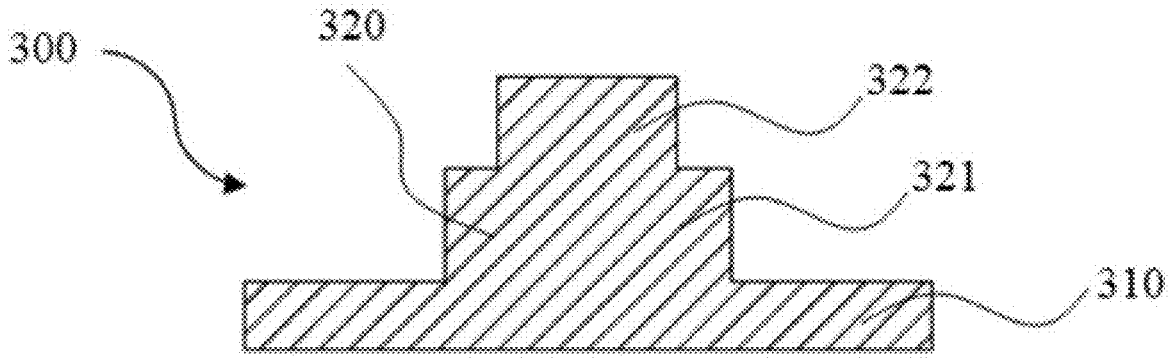
FIG. 9 is a cross-sectional view of a preferred embodiment of a cover sheet in the bracket for modular luminaires according to the present disclosure.

Further, in the present embodiment, the cover sheet 300 is included. As shown in FIG. 9, the cover sheet 300 includes the sheet body 310 and the snap-fit portion 320 connected to the sheet body 310.

The sheet body 310 is a decorative sheet having a size matching the surface of the polyhedral module 100 on an outer surface of the bracket for modular luminaires. The snap-fit portion 320 includes the first cylindrical platform 321 provided on the sheet body 310 and the second cylindrical platform 322 coaxially provided on the first cylindrical platform 321. Moreover, a diameter of the second cylindrical platform 322 is smaller than that of the first cylindrical platform 321, so the snap-fit portion 320 forms into a stepped platform matching the stepped through-hole 120.

Figure 11:
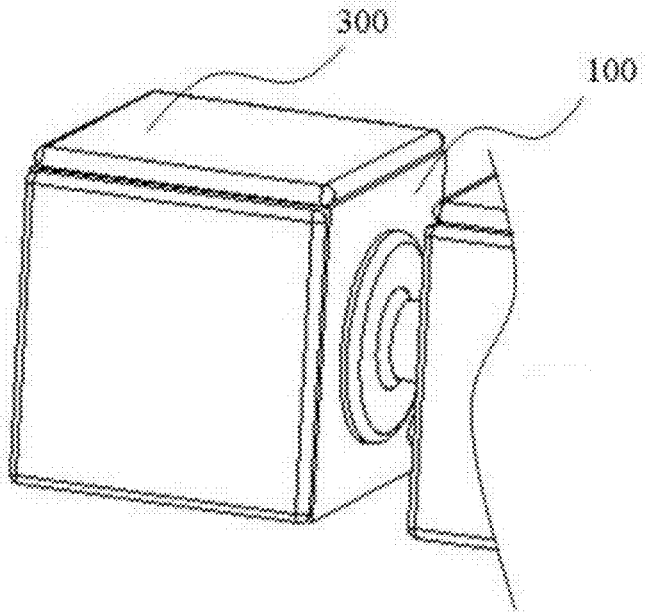
FIG. 11 is a schematic diagram showing a connection between the cover sheet and the polyhedral module in the bracket for modular luminaires according to the present disclosure.

Through the matching of the snap-fit portion 320 with the stepped through-hole 120, the cover sheet 300 is connected to the polyhedral module 100 to form an interference fit, as shown in FIG. 11.

A decorative surface of the cover sheet 300 can be provided with different colors, textures or patterns to play the role of decorating the luminaire. Moreover, the cover sheet 300 and the polyhedral module 100 are detachably connected by the interference fit, which can be conveniently replaced at any time, thereby satisfying the preferences of different groups of people.

Figure 12:
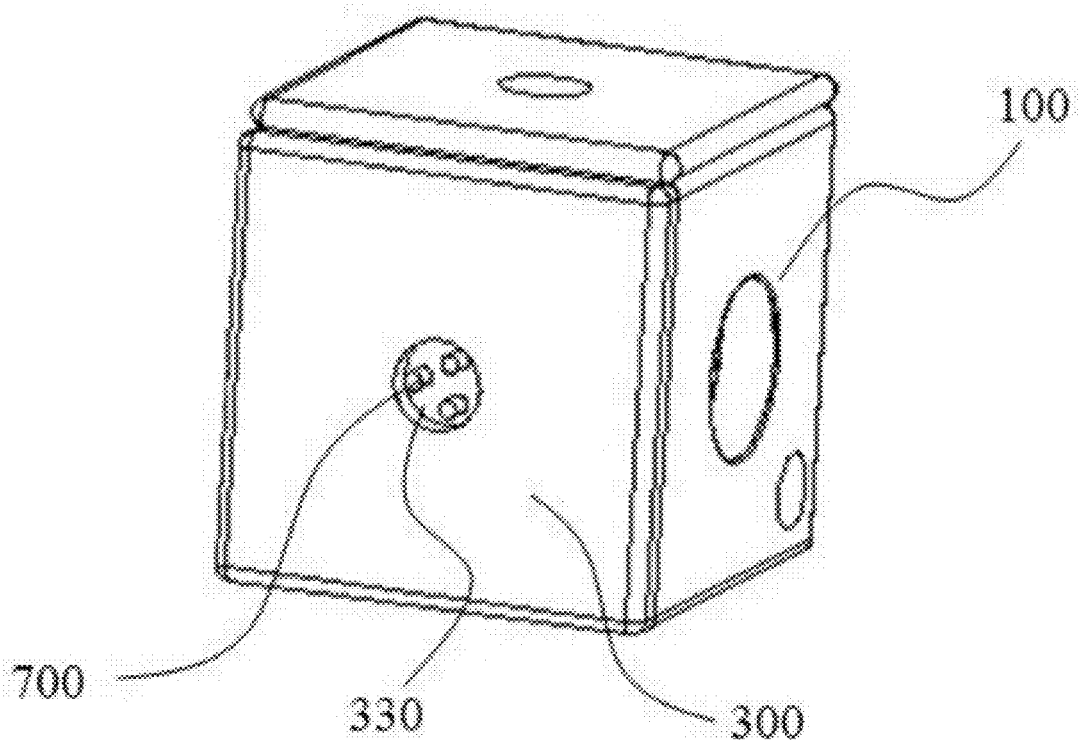
FIG. 12 is a schematic diagram showing a connection between the cover sheet provided with a second through-hole and the polyhedral module in the bracket for modular luminaires according to the present disclosure.

Further, as shown in FIG. 12, the second through-hole 330 is provided on the cover sheet 300. The cover sheet provided with the second through-hole 330 is installed at a position where a power supply port is mounted on the bracket for modular luminaires, so that the power supply port is exposed to facilitate the plugging in of the power supply.

Further, in the present embodiment, the reinforcing strip 400 is included. The reinforcing strip 400 is preferably a metal strip or hard plastic strip.

Figure 14:
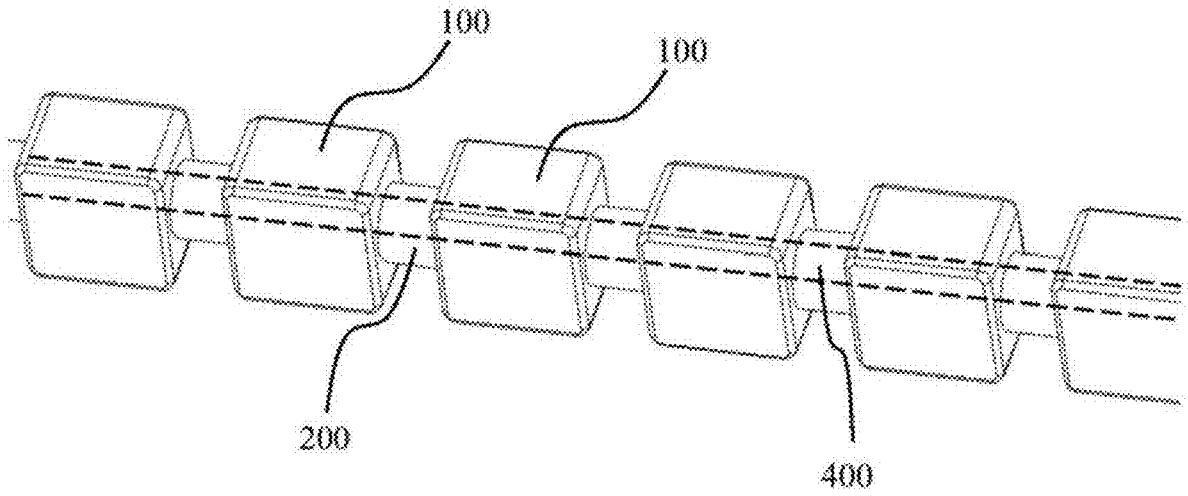
FIG. 14 is a schematic diagram of the bracket for modular luminaires provided with a reinforcing strip according to the present disclosure.

As shown in FIG. 14, the reinforcing strip passes through the stepped through-hole 120 of the plurality of polyhedral modules 100 and the through-hole 211 in the connector body 210, or passes through the first through-hole 140, which is used for reinforcing, fixing and supporting the bracket for modular luminaires. Consequently, the bracket for modular luminaires form an overall structure with a strong bearing capacity.

Further, in the present embodiment, the wire 500 is included. The wire 500 passes through the stepped through-hole 120 of the plurality of polyhedral modules 100 and the through-hole 211 in the connector body 210, or passes through the first through-holes 140 forming an electrical connection in the bracket for modular luminaires.

Figure 2:
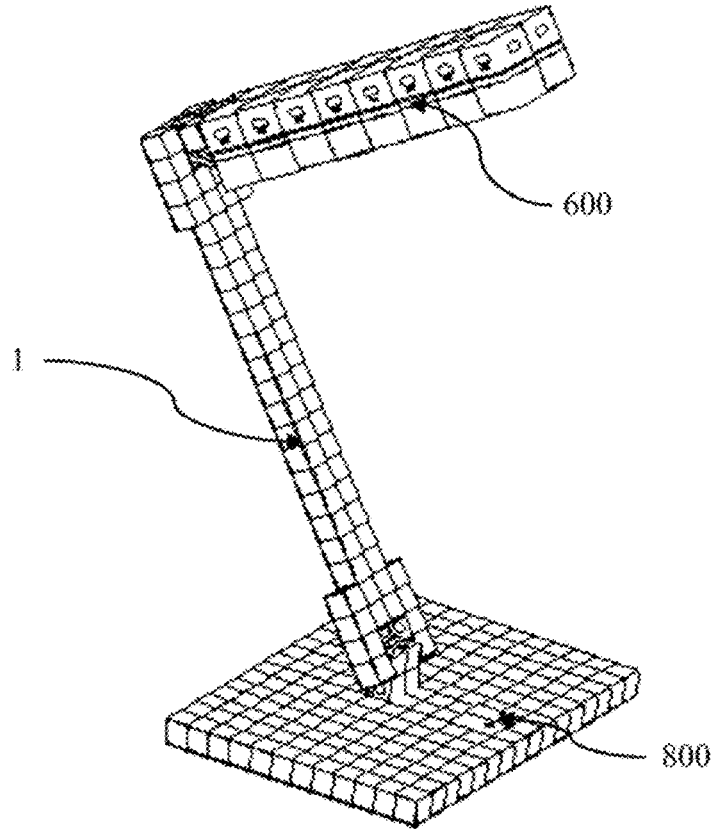
FIG. 2 is a schematic diagram of a luminaire composed of the bracket for modular luminaires and a light source module according to the present disclosure.

The brackets for modular luminaires shown in FIG. 1 and FIG. 2 of the present disclosure are merely exemplary, and beyond that, they may be connected and combined to form into different shapes according to actual needs.

Embodiment 2

The main difference between the present embodiment and Embodiment 1 is that the structure of the cover sheet 300 is different.

Figure 10:
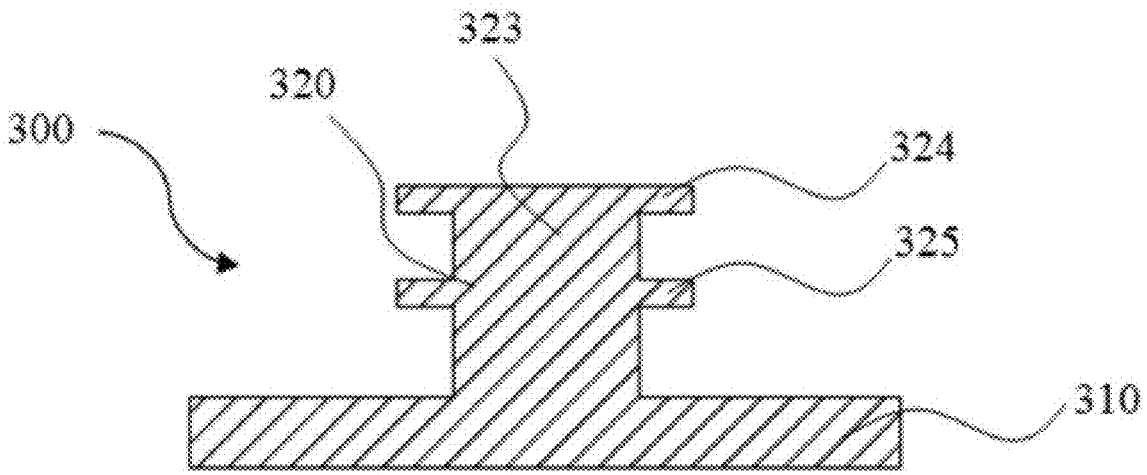
FIG. 10 is a cross-sectional view of another preferred embodiment of the cover sheet in the bracket for modular luminaires according to the present disclosure.

As shown in FIG. 10, the cover sheet 300 includes the sheet body 310 and the snap-fit portion 320 connected to the sheet body 310.

The sheet body is a decorative sheet having a size matching the surface of the polyhedral module 100 on an outer surface of the bracket for modular luminaires.

The snap-fit portion 320 includes the cylinder 323 provided on the sheet body 310, and the sixth annular protrusion 324 and the seventh annular protrusion 325 are formed radially outward on an outer periphery of the cylinder 323. The sixth annular protrusion 324 is spaced apart from the seventh annular protrusion 325.

The snap-fit portion 320 is inserted into the stepped through-hole 120 on the polyhedral module 100, and the first annular protrusion 130 is engaged between the sixth annular protrusion 324 and the seventh annular protrusion 325, making the cover sheet 300 connect to the polyhedral module 100 in a snap-fit manner.

The other structures in the present embodiment are the same as those in Embodiment 1.

Embodiment 3

Figure 13:
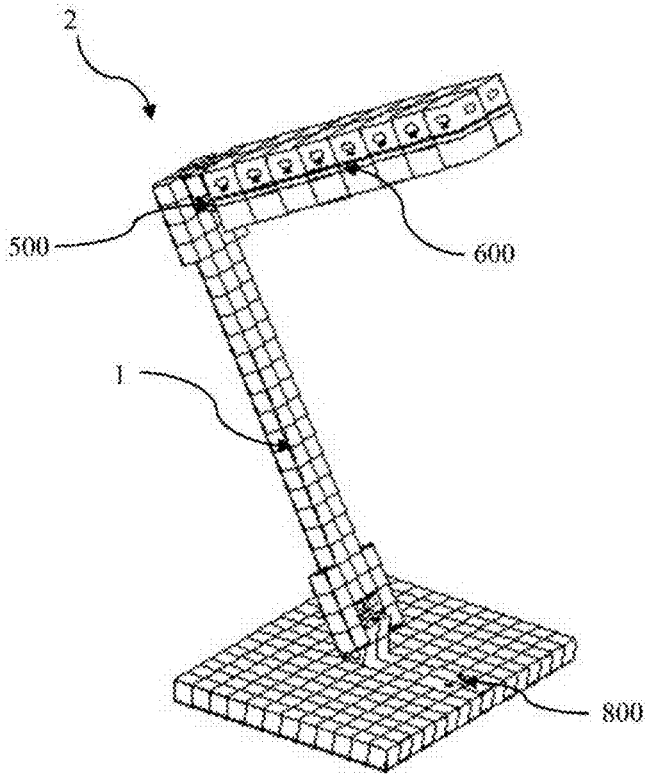
FIG. 13 is a structural schematic diagram of the modular luminaire according to the present disclosure.

The present embodiment discloses the modular luminaire 2. The specific technical solution is as follows:

As shown in FIG. 13, the modular luminaire 2 includes the bracket 1 for modular luminaires as described in Embodiment 1 or 2 and the light source module 600 mounted on bracket 1 for modular luminaires.

The power supply port 700 and the control switch 800 are provided on the bracket 1 for modular luminaires. The power supply port 700 and the control switch 800 are interconnected via a wire. The control switch 800 and the light source module 600 are also interconnected via a wire.

According to the modular luminaire of the present embodiment, the bracket for modular luminaires is provided with the stepped through-hole and the first annular protrusion on the polyhedral module, and with the second annular protrusion, the third annular protrusion, the fourth annular protrusion and the fifth annular protrusion on the connector. Consequently, the polyhedral module and the connector can be detachably connected together in an snap-fit manner; and a plurality of the polyhedral modules are interconnected via the connectors as needed to form the bracket for modular luminaires, thereby solving the problem of "one bracket only corresponds to one luminaire" in the prior art.

It should be noted that all features disclosed in the specification, or the steps of all methods or processes disclosed, may be combined in any manner other than mutually exclusive features and/or steps.

In addition, the above-mentioned specific embodiments are exemplary, and a person skilled in the art can be inspired by the disclosure of the present disclosure to devise various solutions, and these solutions also belong to the disclosed scope of the present disclosure and fall within the protective scope of the present disclosure. It should be understood by a person skilled in the art that the specification and the drawings of the present disclosure are illustrative rather than forming a limitation on claims. The protective scope of the present disclosure is defined by the claims and their equivalents.

What is claimed is:

1. A bracket for a modular luminaire, comprising: a polyhedral module and a connector connected to the polyhedral module;

the polyhedral module is a polyhedron internally provided with a cavity; each surface of the polyhedron is provided with a stepped through-hole connected to the cavity, thereby forming a first annular protrusion at a junction of the stepped through-hole and the cavity;

the connector comprises a connector body having a cylindrical shape; the connector body is provided with a third through-hole along an axial direction; on an outer periphery of the connector body, a second annular protrusion, a third annular protrusion, a fourth annular protrusion, and a fifth annular protrusion protrude outwards in a radial direction and are formed successively from a left end portion to a right end portion of the connector body; the second annular protrusion, the third annular protrusion, the fourth annular protrusion and the fifth annular protrusion are spaced apart;

a left end of the connector is inserted into the stepped through-hole of the polyhedral module, and the first annular protrusion is engaged between the second annular protrusion and the third annular protrusion; the connector is detachably connected to the polyhedral module; and a plurality of the polyhedral modules are interconnected via the connector to form the bracket for the modular luminaire, wherein the bracket further comprising a cover sheet;

the cover sheet comprises a sheet body and a snap-fit portion connected to the sheet body;

the sheet body is a decorative sheet having a size identical to the surface of the polyhedral module on an outer surface of the bracket for the modular luminaire;

the snap-fit portion comprises a cylinder provided on the sheet body; a sixth annular protrusion and a seventh annular protrusion are formed radially outward on an outer periphery of the cylinder; the sixth annular protrusion is spaced apart from the seventh annular protrusion; and the snap-fit portion is inserted into the stepped through-hole of the polyhedral module; the first annular protrusion is engaged between the sixth annular protrusion and the seventh annular protrusion; the cover sheet is connected to the polyhedral module in a snap-fit manner.

2. The bracket for the modular luminaire according to claim 1, wherein, a first through-hole connected to the cavity is further provided on each surface of the polyhedral module; and two first through-holes located on opposite surfaces of the polyhedral module correspond to each other.

3. The bracket for the modular luminaire according to claim 2, further comprising a reinforcing strip; the reinforcing strip passes through the stepped through-hole of the plurality of polyhedral modules and the third through-hole in the connector body, or passes through the first through-hole for reinforcing, fixing and supporting the bracket for the modular luminaire.

4. The bracket for the modular luminaire according to claim 2, further comprising a wire;

the wire passes through the stepped through-hole of the plurality of polyhedral modules and the third through-hole in the connector body, or passes through the first through-hole for forming an electrical connection in the bracket for the modular luminaire.

5. The bracket for the modular luminaire according to claim 1, wherein, a portion between the third annular protrusion and the fourth annular protrusion of the connector body is wavy, zigzag or threaded; and the portion between the third annular protrusion and the fourth annular protrusion of the connector body forms a retractable structure.

6. The bracket for the modular luminaire according to claim 1, wherein, a second through-hole is provided on the cover sheet.

7. A modular luminaire, comprising the bracket for the modular luminaire according to claim 1 and a light source module mounted on the bracket for the modular luminaire.

8. The modular luminaire according to claim 7, wherein, a power supply port and a control switch are provided on the bracket for the modular luminaire; and the power supply port and the control switch are interconnected via a wire; and the control switch and the light source module are interconnected via a wire.

9. The modular luminaire according to claim 8, wherein, a second through-hole is provided on the cover sheet.

10. The modular luminaire according to claim 7, wherein, a first through-hole connected to the cavity is further provided on each surface of the polyhedral module; and two first through-holes located on opposite surfaces of the polyhedral module correspond to each other.

11. The modular luminaire according to claim 7, wherein, a portion between the third annular protrusion and the fourth annular protrusion of the connector body is wavy, zigzag or threaded; and the portion between the third annular protrusion and the fourth annular protrusion of the connector body forms a retractable structure.

12. The modular luminaire according to claim 7, wherein, a second through-hole is provided on the cover sheet.

13. The bracket for the modular luminaire according to claim 1, wherein, a second through-hole is provided on the cover sheet.

* * * * *